US010998679B2

(12) United States Patent
Long et al.

(10) Patent No.: US 10,998,679 B2
(45) Date of Patent: May 4, 2021

(54) ELECTRICAL CONNECTOR IMPROVING HIGH FREQUENCY CHARACTERISTICS

(71) Applicant: LOTES CO., LTD, Keelung (TW)

(72) Inventors: Quan Long, Keelung (TW); Ming Jiang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/863,047

(22) Filed: Apr. 30, 2020

(65) Prior Publication Data

US 2020/0381869 A1 Dec. 3, 2020

(30) Foreign Application Priority Data

May 28, 2019 (CN) ..... 201910451462.8

(51) Int. Cl.
*H01R 13/6471* (2011.01)
*H01R 13/6587* (2011.01)

(52) U.S. Cl.
CPC ..... *H01R 13/6471* (2013.01); *H01R 13/6587* (2013.01)

(58) Field of Classification Search
CPC ..... H01R 13/6461; H01R 13/6473; H01R 13/6471; H01R 13/6476; H01R 13/6587;
(Continued)

(56) References Cited

U.S. PATENT DOCUMENTS 6,375,498 B1 * 4/2002 Yu ..... H01R 12/7029 439/567
6,716,039 B1 * 4/2004 Peloza ..... H01R 12/7011 439/637
(Continued)

FOREIGN PATENT DOCUMENTS

CN 100389523 C 5/2008
CN 100536254 C 9/2009
(Continued)

OTHER PUBLICATIONS

CN204391414U_Description_202011121645 (Year: 2015).*

*Primary Examiner* — Abdullah A Riyami
*Assistant Examiner* — Marcus E Harcum
(74) *Attorney, Agent, or Firm* — Locke Lord LLP; Tim Tingkang Xia, Esq.

(57) ABSTRACT

An electrical connector includes: an insulating block, provided with at least one adjusting groove; and a plurality of terminals, fixed to the insulating block and arranged in at least one row. The terminals include at least one pair of differential signal terminals and at least two ground terminals. Each of two opposite sides of the pair of differential signal terminals is provided with a corresponding one of the ground terminals. The adjusting groove is provided between only one of the two opposite sides of the pair of differential signal terminals and the corresponding one of the ground terminals, such that electric charges and electric fields between the pair of differential signal terminals and the ground terminals at the two sides are not distributed uniformly, thus reducing the ground mode resonance of the ground terminals to the differential signal terminals, and improving the high frequency performance of the electrical connector.

10 Claims, 12 Drawing Sheets

(58) Field of Classification Search
CPC .... H01R 12/71; H01R 12/712; H01R 12/718; H01R 12/721; H01R 12/722; H01R 12/716; H01R 12/714
USPC ..... 439/71, 637, 941
See application file for complete search history.

(56) References Cited

U.S. PATENT DOCUMENTS 6,899,548 B2 * 5/2005 Houtz ..... H01R 12/725 439/607.05
7,108,554 B2 * 9/2006 Huang ..... H01R 13/6594 439/607.01
7,189,090 B2 * 3/2007 Aizawa ..... H01R 13/6581 439/260
7,229,315 B2 * 6/2007 Zhang ..... H01R 13/658 439/607.31
7,445,502 B2 * 11/2008 Zhang ..... H01R 13/658 439/607.01
7,445,504 B1 * 11/2008 Zhang ..... H01R 13/6594 439/607.01
7,731,541 B1 * 6/2010 Lee ..... H01R 23/688 439/660
8,231,411 B1 * 7/2012 Westman ..... H01R 13/6471 439/607.05
9,166,320 B1 * 10/2015 Herring ..... H01R 13/6592
9,373,920 B2 * 6/2016 Miki ..... H01R 12/00
9,461,378 B1 * 10/2016 Chen ..... H01R 13/6594
9,478,884 B2 * 10/2016 Tsai ..... H01R 12/724
9,728,883 B1 * 8/2017 Lin ..... H01R 13/405
9,728,899 B2 * 8/2017 Peng ..... H01R 13/6597
9,742,132 B1 * 8/2017 Hsueh ..... H01R 13/516
9,755,348 B2 * 9/2017 Guo ..... H01R 12/722
9,917,405 B2 * 3/2018 Ju ..... H01R 13/6583
9,935,385 B2 * 4/2018 Phillips ..... H01R 13/516
10,050,369 B1 * 8/2018 Yang ..... H01R 13/405
10,056,710 B1 * 8/2018 Yang ..... H01R 13/518
10,135,197 B2 * 11/2018 Little ..... H01R 13/6585
10,439,311 B2 * 10/2019 Phillips ..... H01R 13/2442
10,777,921 B2 * 9/2020 Lu ..... H01R 12/82
10,797,450 B2 * 10/2020 Chen ..... H01R 13/6581
2015/0236437 A1 * 8/2015 Briant ..... H01R 12/737 439/636
2017/0179651 A1 * 6/2017 Chen ..... H01R 24/76
2018/0062319 A1 * 3/2018 Chang ..... H01R 13/646
2018/0115119 A1 * 4/2018 Little ..... H01R 13/6658
2018/0212376 A1 * 7/2018 Wang ..... H01R 13/631
2019/0067876 A1 * 2/2019 Tang ..... H01R 13/6471
2019/0131743 A1 * 5/2019 Hsu ..... H01R 13/405
2019/0372274 A1 * 12/2019 Feng ..... H01R 12/721
2020/0076135 A1 * 3/2020 Tang ..... H01R 12/724
2020/0335890 A1 * 10/2020 Liu ..... H01R 12/7023
2020/0350717 A1 * 11/2020 Dong ..... H01R 13/11

FOREIGN PATENT DOCUMENTS

CN 203536644 U 4/2014
CN 204391414 U 6/2015
CN 206211123 U 5/2017
CN 108832339 B 10/2019

* cited by examiner

A-A

B-B

ELECTRICAL CONNECTOR IMPROVING HIGH FREQUENCY CHARACTERISTICS

CROSS-REFERENCE TO RELATED PATENT APPLICATION

This non-provisional application claims priority to and the benefit of, pursuant to 35 U.S.C. § 119(a), patent application Serial No. CN201910451462.8 filed in China on May 28, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector capable of improving high frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The electrical connector is a medium for exchanging electronic signals between different electronic devices. A conventional electrical connector includes an insulating body having an insertion slot, and two rows of terminals respectively fixed to two insulating blocks and then assembled to the insulating body. Each row of terminals includes multiple pairs of differential signal terminals and multiple ground terminals. Each of two sides of each pair of the differential signal terminals is provided with one of the ground terminals to block crosstalk between two adjacent pairs of the differential signal terminals. Each of the terminals has a fixing portion fixed to the insulating body, a contact portion exposed to the insertion slot to mate with a mating component, and a soldering portion extending backward out of the insulating body from the fixing portion and soldered to a circuit board.

However, with the current improvement of the scientific and technological level, the frequencies of signals transmitted by electrical connectors are increasingly high, and the requirements for high frequency performance of the electrical connectors are also increasingly high. In the conventional electrical connector, the fixing portions are fixed to the insulating blocks, and the dielectric constant of each of the insulating blocks is more than three times larger than that of air, such that the ground terminals at two sides have large ground mode resonance to the differential signal terminals, thereby seriously affecting the high frequency performance of the electrical connector and not satisfying the requirement for transmission of high frequency signals.

Therefore, a heretofore unaddressed need to design a new electrical connector exists in the art to address the aforementioned deficiencies and inadequacies.

SUMMARY

The present invention is directed to an electrical connector, in which an adjusting groove is provided between only one side of a pair of differential signal terminals and a ground terminal, thereby reducing the ground mode resonance and improving high frequency performance.

To achieve the foregoing objective, the present invention adopts the following technical solutions.

An electrical connector includes: an insulating block, provided with at least one adjusting groove; and a plurality of terminals, fixed to the insulating block and arranged in at least one row, wherein the terminals comprise at least one pair of differential signal terminals and at least two ground terminals, each of two opposite sides of the pair of differential signal terminals is provided with a corresponding one of the ground terminals, and the adjusting groove is provided between only one of the two opposite sides of the pair of differential signal terminals and the corresponding one of the ground terminals.

In certain embodiments, the terminals comprise at least two pairs of differential signal terminals and the at least two ground terminals, arranged sequentially as: a ground terminal, a differential signal terminal, a differential signal terminal, a ground terminal, a differential signal terminal, and a differential signal terminal, and the adjusting groove is provided between only one differential signal terminal of one of the pairs of differential signal terminals and a corresponding one of the ground terminals.

In certain embodiments, the ground terminals and the differential signal terminals are not exposed to the adjusting groove.

In certain embodiments, the adjusting groove runs through the insulating block in a thickness direction of the insulating block.

In certain embodiments, the electrical connector includes two insulating blocks and further includes an insulating body, wherein the insulating body has an insertion slot, the terminals are arranged in two rows in a thickness direction of the insulating blocks, each of the two insulating blocks is respectively injection-molded with one of the two rows of the terminals, the two insulating blocks are respectively assembled to the insulating body, each of the terminals has an elastic arm and a contact portion extending from the elastic arm, and the contact portion is exposed to the insertion slot.

In certain embodiments, the electrical connector includes two insulating blocks, wherein the terminals are arranged in two rows, and the adjusting grooves on the two insulating blocks are staggered in a thickness direction of the insulating blocks.

In certain embodiments, the electrical connector further includes an insulating body, wherein the insulating block is provided on the insulating body, the insulating body is provided with a plurality of accommodating grooves to accommodate the terminals, each of the terminals has an elastic arm and a contact portion extending from the elastic arm, and when the contact portion abuts a mating component, a gap of 0 to 0.1 mm exists between the elastic arm and an inner wall of a corresponding one of the accommodating grooves in an abutting direction.

In certain embodiments, each of the ground terminals has a first fixing portion fixed to the insulating block, and one side of the first fixing portion corresponding to the adjusting groove is concavely provided with a first adjusting notch.

In certain embodiments, the first fixing portion is provided with two first adjusting notches, each of two opposite sides of the first fixing portion is respectively provided with one of the two first adjusting notches, each of the differential signal terminals has a second fixing portion fixed to the insulating block, the second fixing portion is provided with two second adjusting notches, each of two opposite sides of the second fixing portion is provided with one of the two second adjusting notches, and the adjusting groove is provided between one of the first adjusting notches and one of the second adjusting notches.

In certain embodiments, one of the ground terminals adjacent to the adjusting groove and one of the differential signal terminals adjacent to the adjusting groove are respectively located at two sides of the adjusting groove, the one of the ground terminals adjacent to the adjusting groove has a first virtual center line along an extending direction thereof, the one of the differential signal terminals adjacent to the adjusting groove has a second virtual center line along an extending direction thereof, and a distance between the adjusting groove and the first virtual center line is equal to a distance between the adjusting groove and the second virtual center line.

Compared with the related art, the electrical connector according to certain embodiments of the present invention has the following beneficial effects:

Each of two opposite sides of the pair of differential signal terminals is provided with a corresponding one of the ground terminals. The adjusting groove is provided between only one side of the pair of differential signal terminals and the corresponding ground terminal, and no adjusting groove is provided between the other side of the pair of differential signal terminals and the corresponding ground terminal. Thus, a space between one side of the pair of differential signal terminals and the corresponding ground terminal is filled with air, and a portion of each of the insulating blocks is provided between the other side of the pair of differential signal terminals and the corresponding ground terminal. The dielectric constant of air is smaller than that of the insulating block, such that the dielectric constants of the two sides of the pair of differential signal terminals are unbalanced, and electric charges and electric fields between the pair of differential signal terminals and the ground terminals at the two sides are not distributed uniformly, thus reducing the ground mode resonance of the ground terminals to the differential signal terminals, and improving the high frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
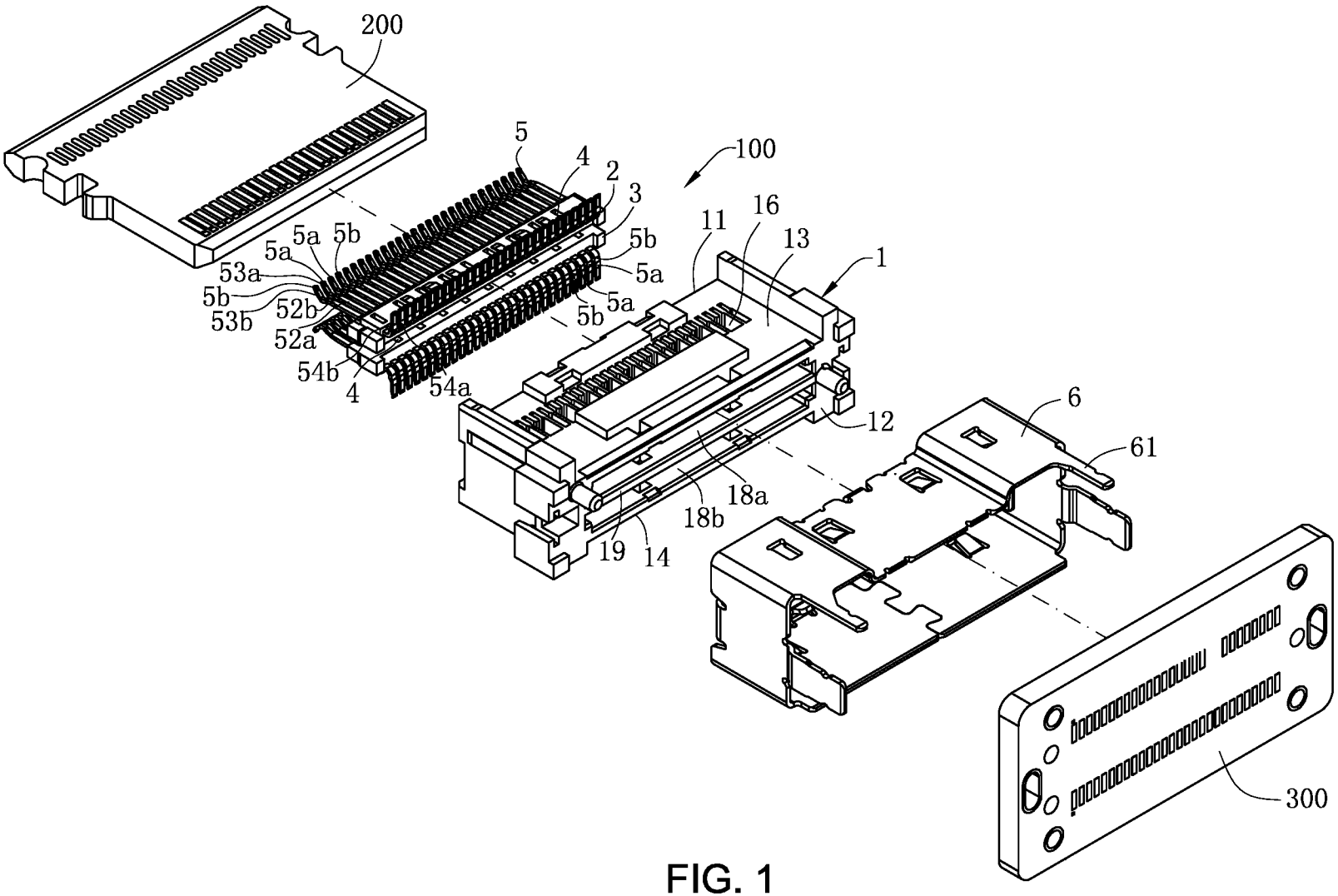
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

Figure 2:
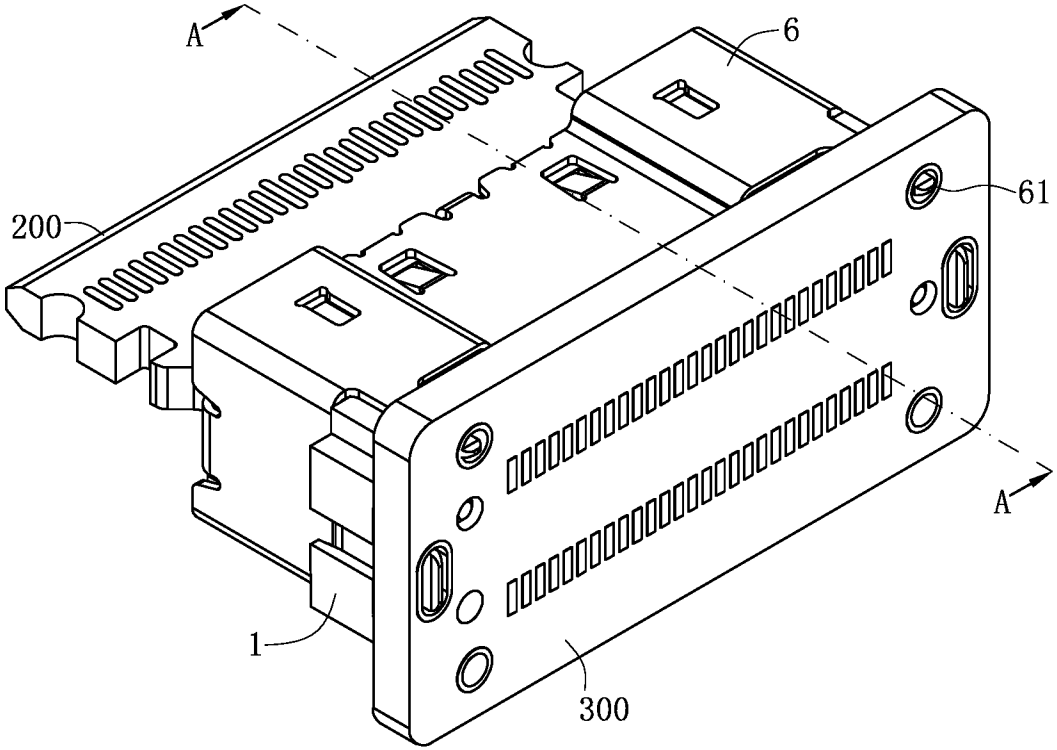
FIG. 2 is a perspective assembled view of FIG. 1.
Figure 3:
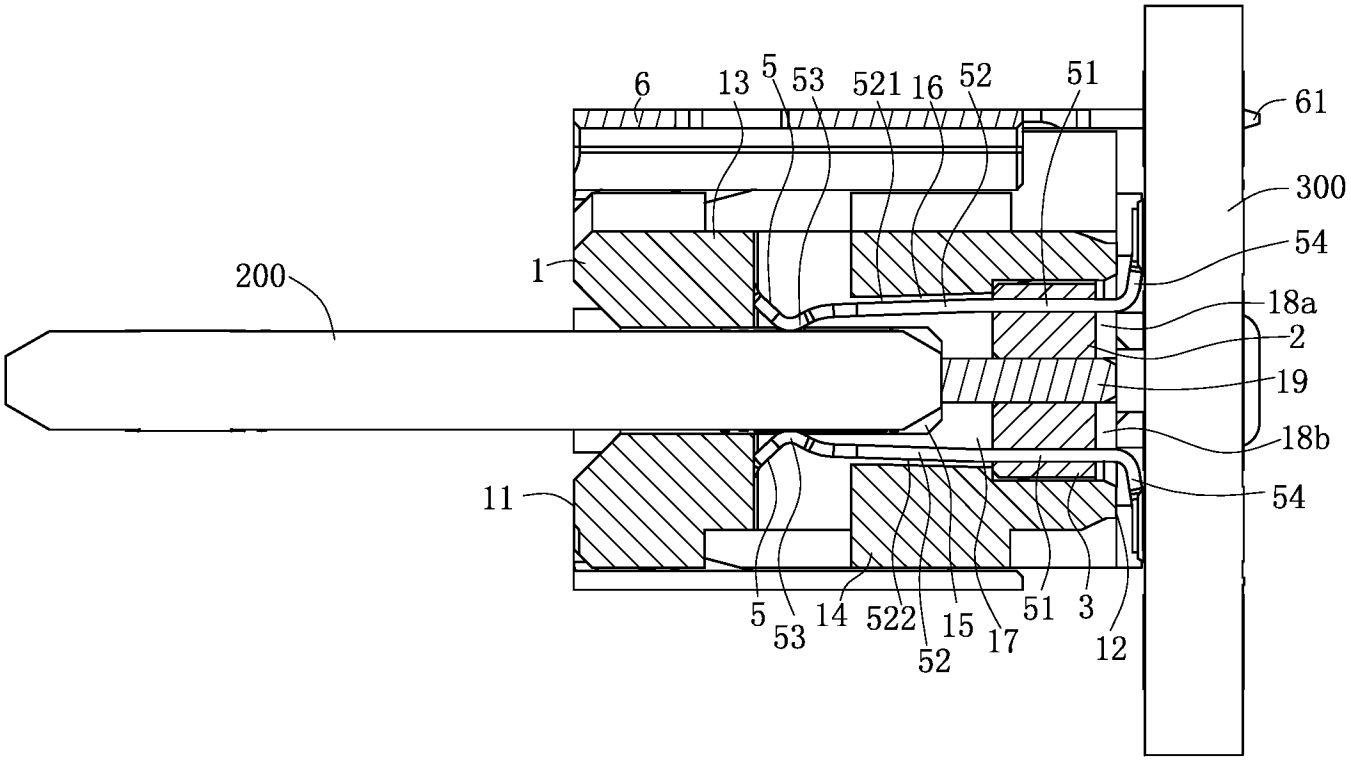
FIG. 3 is a sectional view of FIG. 2 along an A-A direction.

As shown in FIG. 1 to FIG. 3, an electrical connector 100 according to certain embodiments of the present invention is used to electrically connect a mating component 200 with a circuit board 300. The electrical connector 100 includes an insulating body 1, a first insulating block 2 and a second insulating block 3 assembled to the insulating body 1, upper and lower rows of terminals 5 respectively injection-molded with the first insulating block 2 and the second insulating block 3, and a metal shell 6 covering outside the insulating body 1.

As shown in FIG. 1 to FIG. 3, the insulating body 1 is elongated and injection molded, and has a front end surface 11 and a rear end surface 12 opposite to each other, as well as a top wall 13 and a bottom wall 14 opposite to each other. The top wall 13 is located above the bottom wall 14, and the top wall 13 and the bottom wall 14 are connected to the front end surface 11 and the rear end surface 12. An insertion slot 15 is concavely provided backward on the front end surface 11, and the insertion slot 15 extends in a longitudinal direction. The top wall 13 is provided with a plurality of first accommodating grooves 16 arranged at an upper side of the insertion slot 15 in the longitudinal direction, and the first accommodating grooves 16 are in communication with the insertion slot 15 downward and run through the top wall 13 upward. The bottom wall 14 is provided with a plurality of second accommodating grooves 17 arranged at a lower side of the insertion slot 15 in the longitudinal direction, and the second accommodating grooves 17 are in communication with the insertion slot 15 upward and run through the bottom wall 14 downward. A first accommodating cavity 18*a* and a second accommodating cavity 18*b* are concavely provided forward on the rear end surface 12 and are right opposite to each other vertically. A partition 19 is provided between the first accommodating cavity 18*a* and the second accommodating cavity 18*b*.

Figure 4:
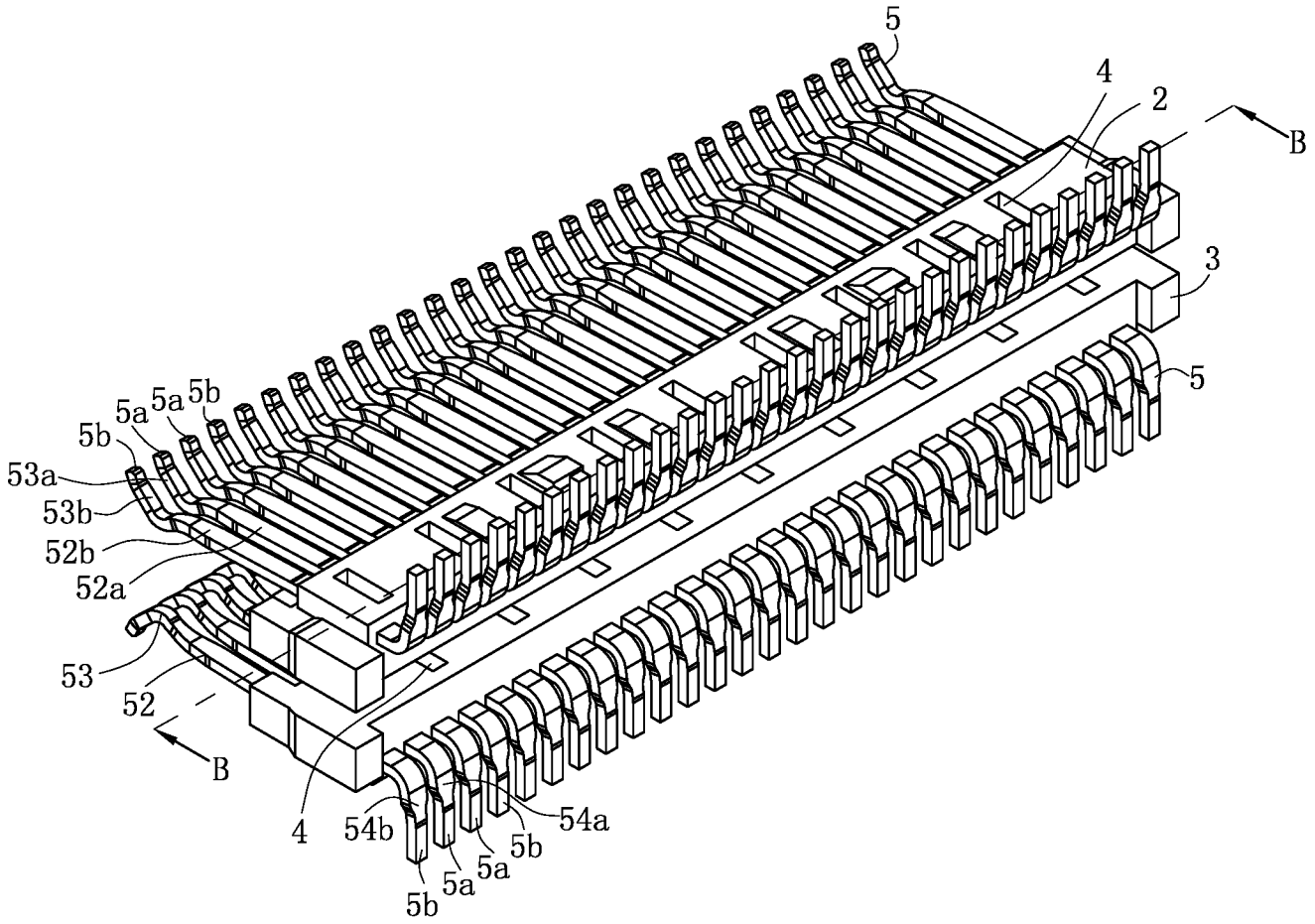
FIG. 4 is a perspective schematic view of upper and lower rows of terminals of the electrical connector according to certain embodiments of the present invention.
Figure 5:
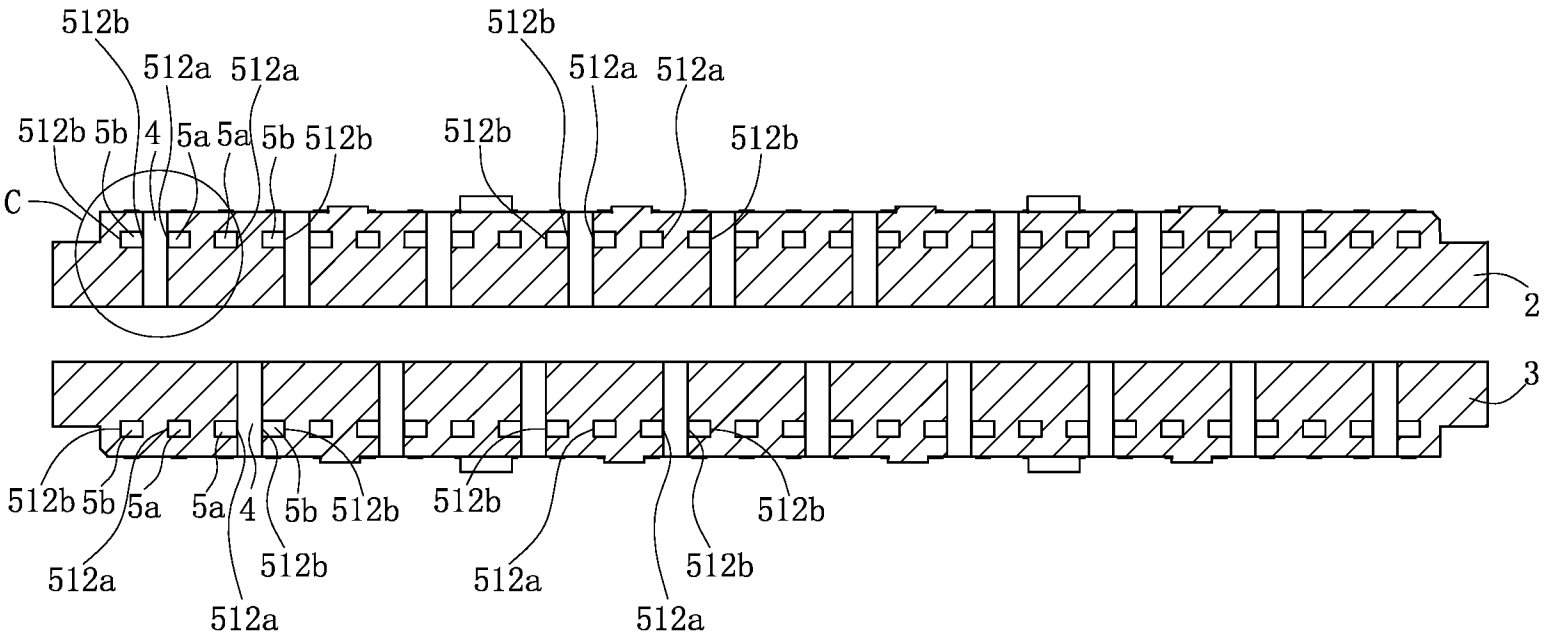
FIG. 5 is a sectional view of FIG. 4 along a B-B direction.
Figure 6:
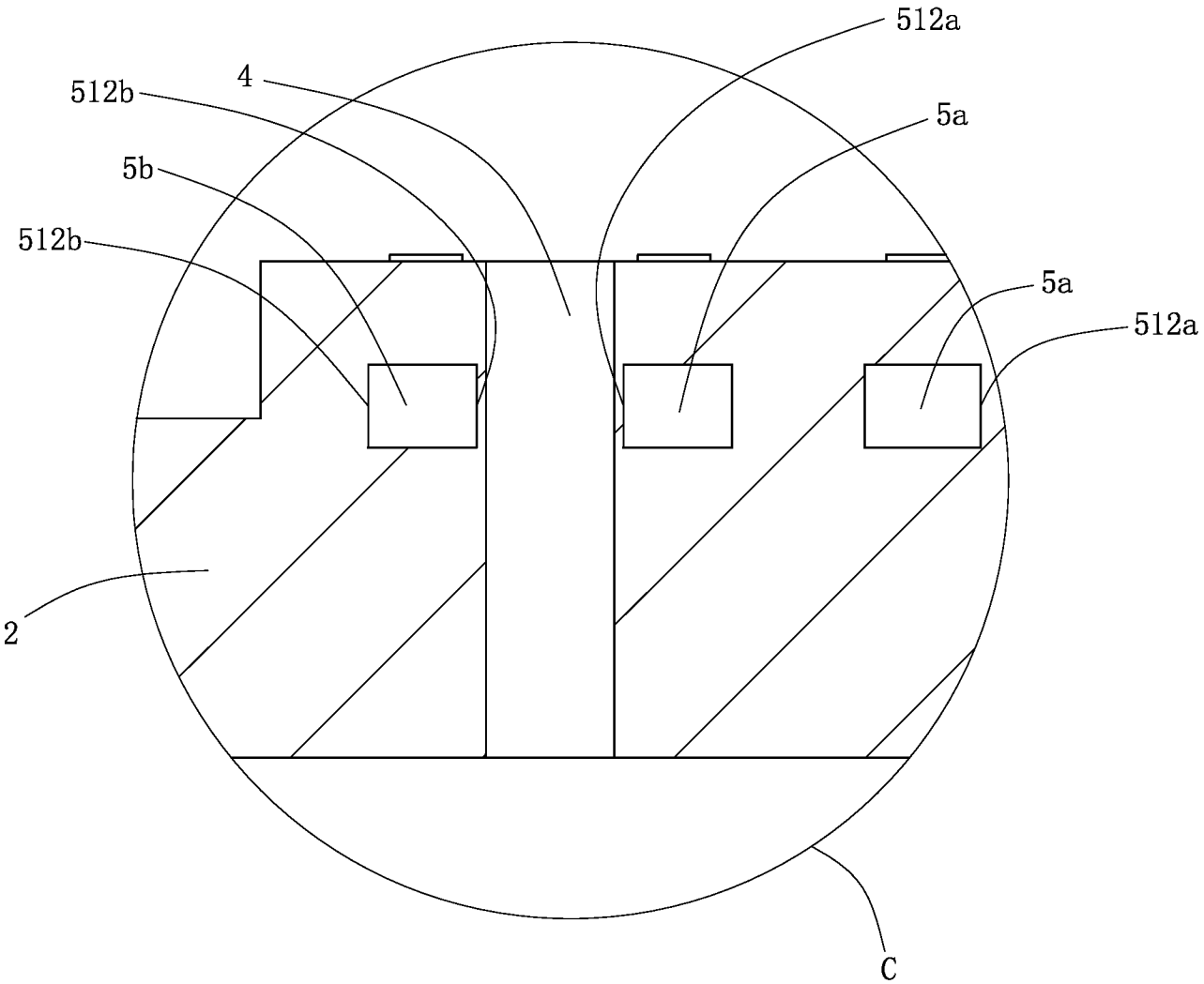
FIG. 6 is an enlarged view of a portion C in FIG. 5.
Figure 7:
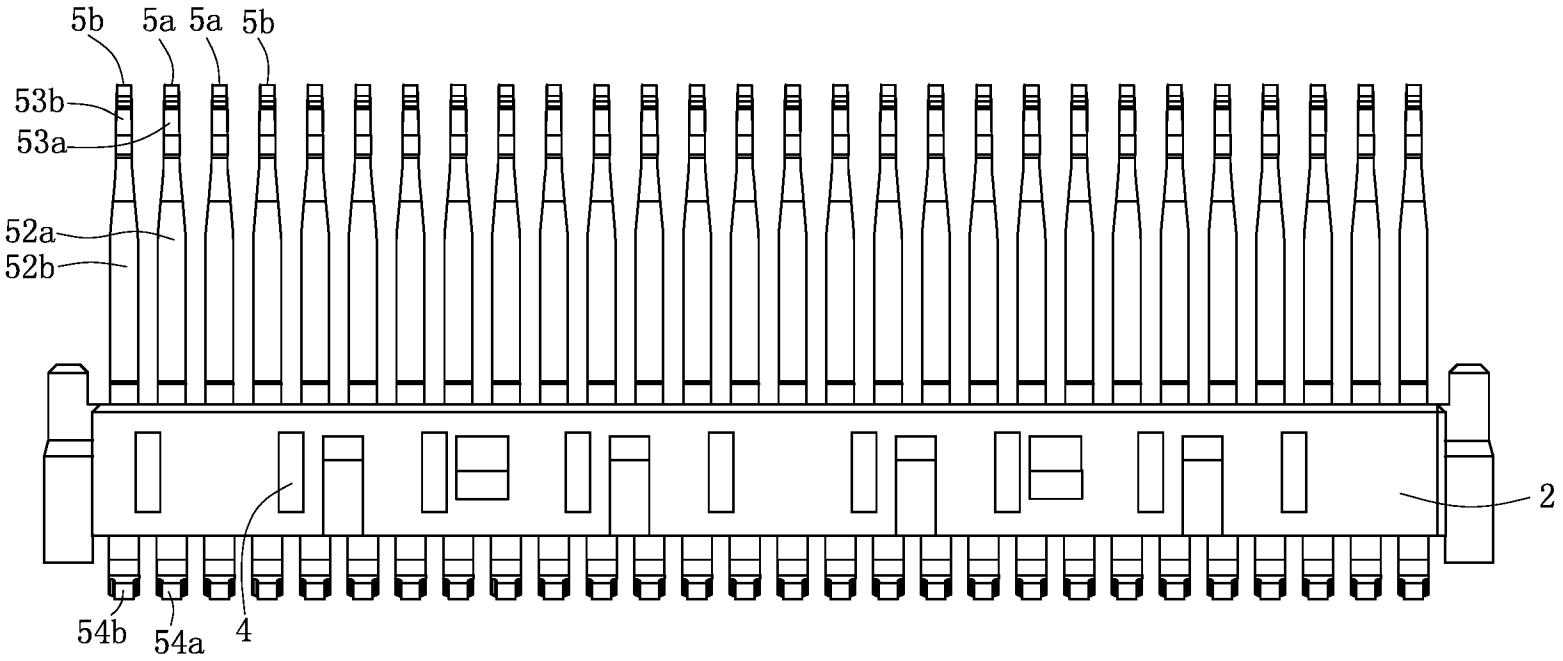
FIG. 7 is a top view showing the upper row of terminals of the electrical connector according to certain embodiments of the present invention being injection-molded with a first insulating block together.
Figure 8:
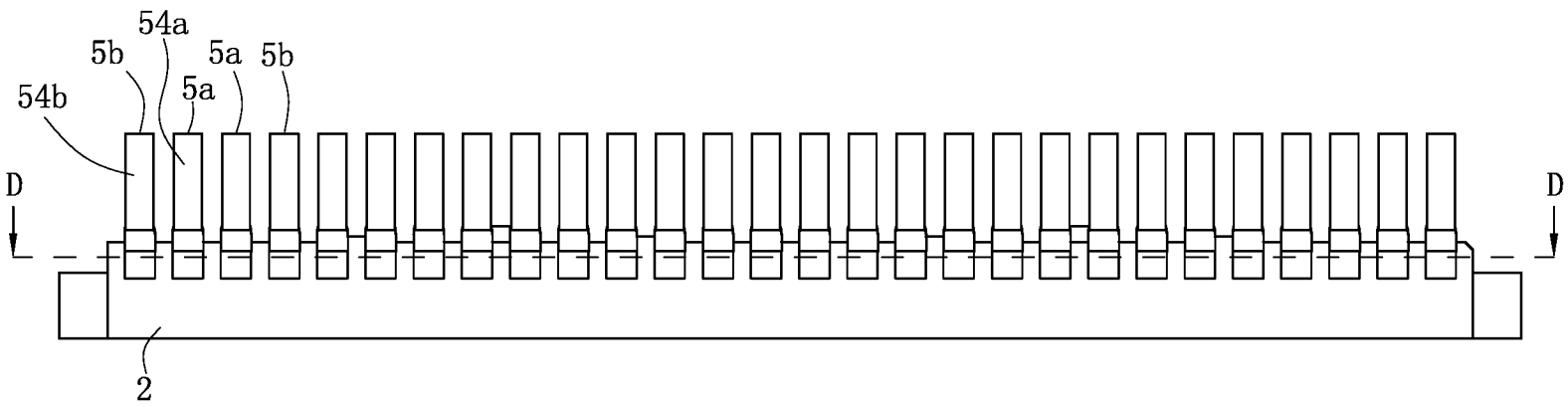
FIG. 8 is a side view showing the upper row of terminals of the electrical connector according to certain embodiments of the present invention being injection-molded with a first insulating block together.

As shown in FIG. 1, FIG. 4, FIG. 7 and FIG. 9, the first insulating block 2 and the insulating body 1 are individually formed. The first insulating block 2 is elongated and assembled to the first accommodating cavity 18*a*. The first insulating block 2 is provided with a plurality of adjusting grooves 4 arranged at intervals in the longitudinal direction, and the adjusting grooves 4 run through the first insulating block 2 vertically. The second insulating block 3 and the insulating body 1 are individually formed. The second insulating block 3 is elongated and assembled to the second accommodating cavity 18*b*. The second insulating block 3 is provided with a plurality of adjusting grooves 4 arranged at intervals in the longitudinal direction, and the adjusting grooves 4 run through the second insulating block 3 vertically. The first insulating block 2 and the second insulating block 3 are respectively formed and injection-molded by the same mold, without requiring two separate molds, thus reducing the manufacturing cost. In other embodiments, the first insulating block 2 and the second insulating block 3 may be integrally provided with the insulating body 1. As shown in FIG. 2 to FIG. 4, the terminals 5 are arranged in an upper row and a lower row. The two rows of terminals 5 are respectively injection-molded and fixed together with the first insulating block 2 and the second insulating block 3. The terminals 5 in the upper row are correspondingly accommodated in the first accommodating grooves 16, and the terminals 5 in the lower row are correspondingly accommodated in the second accommodating grooves 17. Each row of terminals 5 includes a plurality of pairs of differential signal terminals 5*a* and a plurality of ground terminals 5*b*. The terminals 5 in each row are arranged sequentially as: a ground terminal 5*b*, a differential signal terminal 5*a*, a differential signal terminal 5*a*, a ground terminal 5*b*, a differential signal terminal 5*a*, a differential signal terminal 5*a*, a ground terminal 5*b* . . . with repeated configuration of multiple sub-sequences of the "ground terminal-differential signal terminal-differential signal terminal". Viewing downward from top thereof, in the upper row of terminals 5, one of the adjusting grooves 4 is provided between only the left side of each pair of differential signal terminals 5*a* and the corresponding ground terminal 5*b*, and in the lower row of terminals 5, one of the adjusting grooves 4 is provided between only the right side of each pair of differential signal terminals 5*a* and the ground terminal 5*b*, such that the adjusting grooves 4 on the first insulating block 2 and the adjusting grooves 4 on the second insulating block 3 are vertically staggered. Because the first insulating block 2 and the second insulating block 3 are provided with the adjusting grooves 4, the medium coefficient between the upper and lower rows of terminals 5 is reduced, further increasing the signal transmission characteristics of to upper and lower rows of terminals 5. The staggered arrangement of the adjusting grooves 4 in the upper and lower rows can reduce crosstalk when the upper and lower rows of terminals 5 transmit signals. In addition, the differential signal terminals 5*a* and the ground terminals 5*b* are not exposed to the adjusting grooves 4 (as shown in FIG. 5 and FIG. 6). The dielectric constants of the first insulating block 2 and the second insulating block 3 are higher than the dielectric constant of air, such that the differential signal terminals 5*a* and the ground terminals 5*b* at the two sides of each of the adjusting grooves 4 in the upper row are completely covered by the first insulating block 2, and the differential signal terminals 5*a* and the ground terminals 5*b* at the two sides of each of the adjusting grooves 4 in the lower row are completely covered by the second insulating block 3. Further, the dielectric constant of the medium between the differential signal terminals 5*a* and the ground terminals 5*b* in the upper row is between the dielectric constants of the first insulating block 2 and the air and the dielectric constant of the medium between the differential signal terminals 5*a* and the ground terminals 5*b* in the lower row is between the dielectric constants of the second insulating block 3 and the air, thus effectively reducing the ground mode resonance of the ground terminals 5*b* to the differential signal terminals 5*a*. Each ground terminal 5*b* has a first virtual center line L1 along an extending direction thereof, each differential signal terminals 5*a* have a second virtual center line L2 along an extending direction thereof, and each of the adjusting grooves 4 has a third virtual center line L3 in the extending directions of the ground terminals 5*b* and the differential signal terminals 5*a*. A distance S1 between the third virtual center line L3 and the first virtual center line L1 adjacent to each other is equal to a distance S2 between the third virtual center line L3 and the second virtual center line L2 adjacent to each other, and each of the adjusting grooves 4 is located at a center location between the ground terminal 5*b* and the differential signal terminal 5*a* adjacent thereto, such that the impedance of the differential signal terminals 5*a* can be neutrally adjusted, further optimizing the ground mode resonance of the ground terminals 5*b*, and making the resonance points within a controllable range.

As shown in FIG. 3, FIG. 4, FIG. 8 and FIG. 9, each ground terminal 5*b* includes a first fixing portion 51*b* correspondingly fixed to the first insulating block 2 and the second insulating block 3. A first adjusting notch 511*b* is provided at each of two opposite sides of the first fixing portion 51*b*. One side of the first fixing portion 51*b* corresponding to the adjusting groove 4 is concavely provided with one first adjusting notch 511*b*, such that the ground terminal 5*b* is further away from the differential signal terminal 5*a*, thereby reducing the energy of the ground mode resonance generated by the ground terminal 5*b*. The first fixing portion 51*b* has a plurality of side edges defined as a plurality of first side edges 512*b*, and the first fixing portion 51*b* has two first side edges 512*b* opposite to each other (see also FIG. 5 and FIG. 6). In addition, each adjusting groove 4 is provided correspondingly adjacent to the first adjusting notch 511*b*, and the dielectric constant of air is relatively small, such that the ground terminal 5*b* can better adjust the ground mode resonance.

As shown in FIG. 3, FIG. 4, FIG. 8 and FIG. 9, each differential signal terminal 5*a* includes a second fixing portion 51*a* correspondingly fixed to the first insulating block 2 and the second insulating block 3. A second adjusting notch 511*a* is provided at each of two opposite sides of the second fixing portion 51*a*. The second fixing portion 51*a* has two side edges, and one of the side edges of the second fixing portion 51*a* adjacent to the first fixing portion 51*b* is defined as a second side edge 512*a*. In other words, each pair of differential signal terminals 5*a* has two second side edges 512*a* (see also FIG. 5 and FIG. 6). Each adjusting groove 4 is provided between the first adjusting notch 511*b* and the second adjusting notch 511*a*, which can adjust the impedance of the differential signal terminals 5*a* and optimize the crosstalk disturbance between the differential signal terminals 5*a*.

Figure 9:
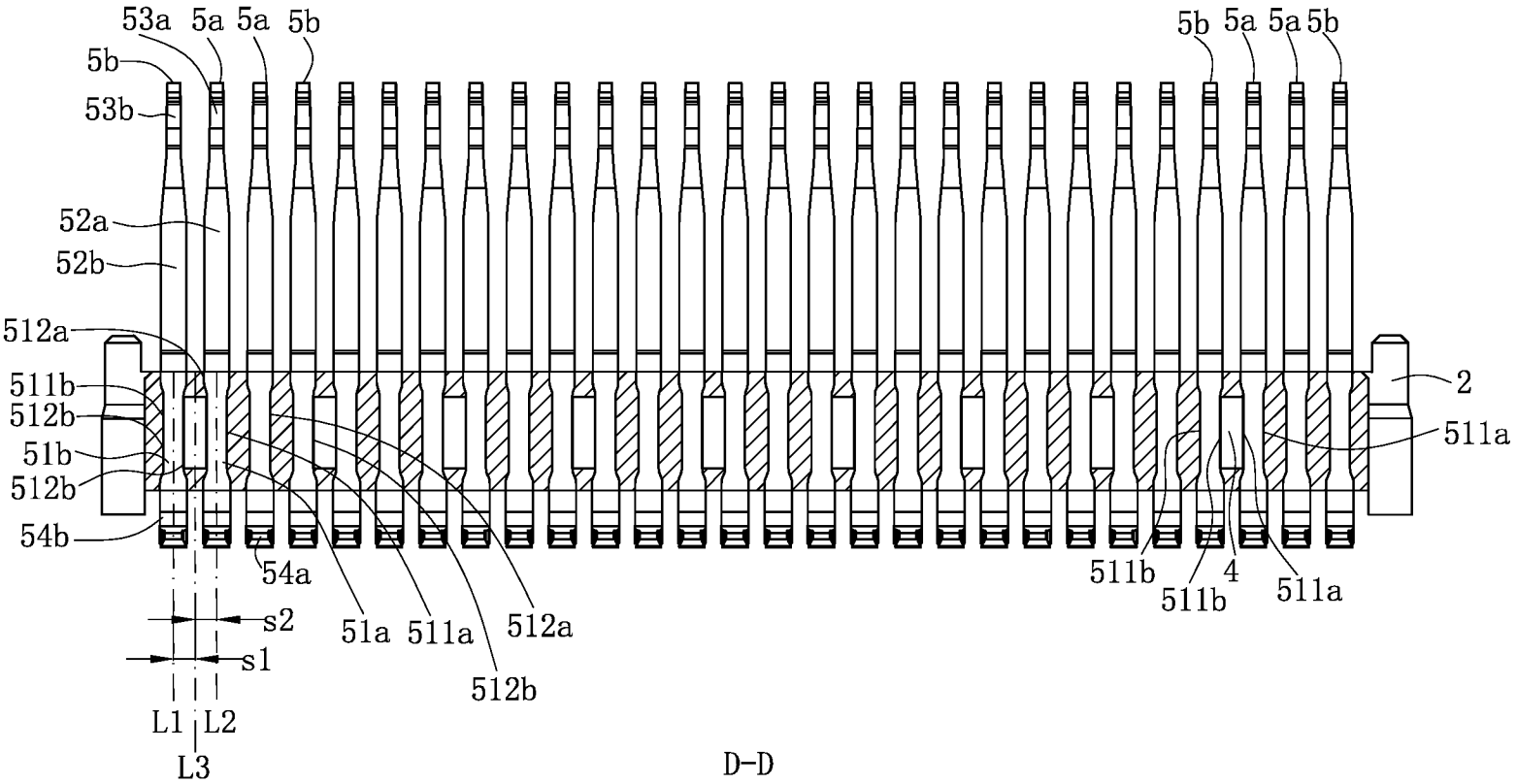
FIG. 9 is a sectional view of FIG. 8 along a D-D direction.

As shown in FIG. 5, FIG. 6 and FIG. 9, for each pair of the differential signal terminals 5*a*, the adjusting groove 5*b* is provided between only one second side edge 512*a* of the two second side edges 512*a* of the pair of differential signal terminals 5*a* and one of the first side edges 512*b* of the corresponding one of the ground terminals 5*b* located farthest from the one second side edge 512*a*. For example, as shown in FIG. 5, viewing downward from top thereof, in the upper row of terminals 5, the corresponding adjusting groove 4 is provided between only the left second side edge 512*a* of each pair of differential signal terminals 5*a* and the left first side edge 512*b* of the corresponding ground terminal 5*b*, and in the lower row of terminals 5, the corresponding adjusting groove 4 is provided between only the right second side edge 512*a* of each pair of differential signal terminals 5*a* and the right first side edge 512*b* of the corresponding ground terminal 5*b*.

As shown in FIG. 3, FIG. 4, FIG. 8 and FIG. 9, a first elastic arm 52*b* extends forward from the first fixing portion 51*b*, and a first contact portion 53*b* extends forward from the first elastic arm 52*b* to be exposed to the insertion slot 15 and abut the mating component 200. A second elastic arm 52*a* extends forward from the second fixing portion 51*a*, and a second contact portion 53*a* extends forward from the second elastic arm 52*a* to be exposed to the insertion slot 15 and abut the mating component 200. When the first contact portion 53*b* and the second contact portion 53*a* abut the mating component 200 to be in an operating state, gaps of 0 to 0.1 mm exist between top surfaces 521 of the first elastic arm 52*b* and the second elastic arm 52*a* of the upper row of terminal 5 and inner wall surfaces of the corresponding first accommodating grooves 16, and gaps of 0 to 0.1 mm exist between bottom surfaces 522 of the first elastic arm 52*b* and the second elastic arm 52*a* of the lower row of terminal 5 and inner wall surfaces of the corresponding second accommodating grooves 17. When the mechanical properties of the electrical connector 100 are satisfied, the gaps between the elastic arms 52 and the insulating body 1 are minimized, and the dielectric constant of the insulating body 1 is relatively larger, such that the increase in the dielectric constant of the medium around the elastic arms 52 may effectively reduce the impedance of the terminals 5, thereby improving the high frequency performance. A first soldering portion 54*b* extends backward from the first fixing portion 51*b*, and a second soldering portion 54*a* extends backward from the second fixing portion 51*a* for soldering to the circuit board 300.

As shown in FIGS. 1 to 2, the metal shell 6 covers outside the insulating body 1, and is buckled and fixed to the insulating body 1. The metal shell 6 has four soldering pins 61 soldered to the circuit board 300 to shield the interference of external signals to the electrical connector 100.

Figure 10:
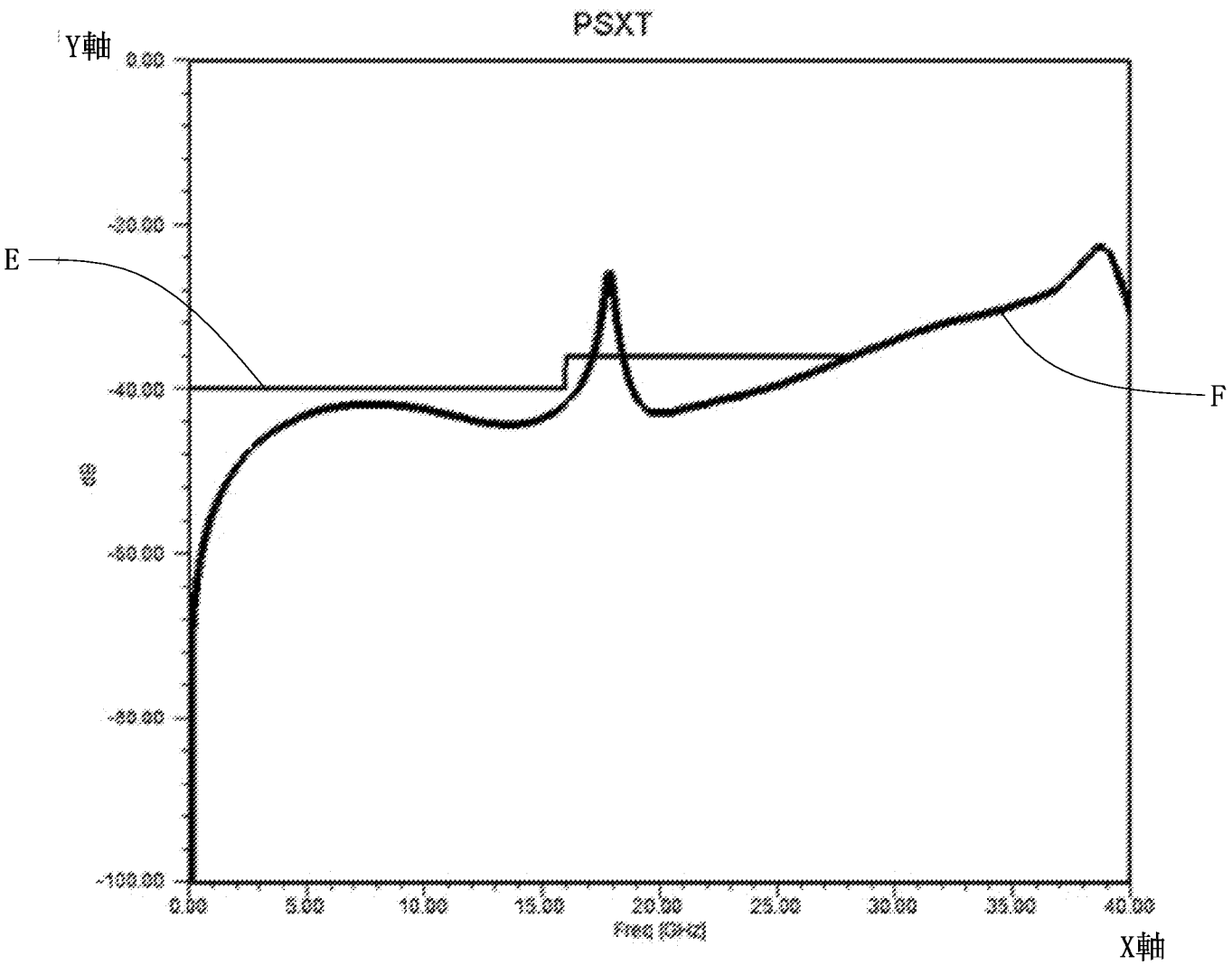
FIG. 10 is a crosstalk summation diagram PSXT of the first insulating block and the second insulating block not being provided with adjusting grooves.
Figure 11:
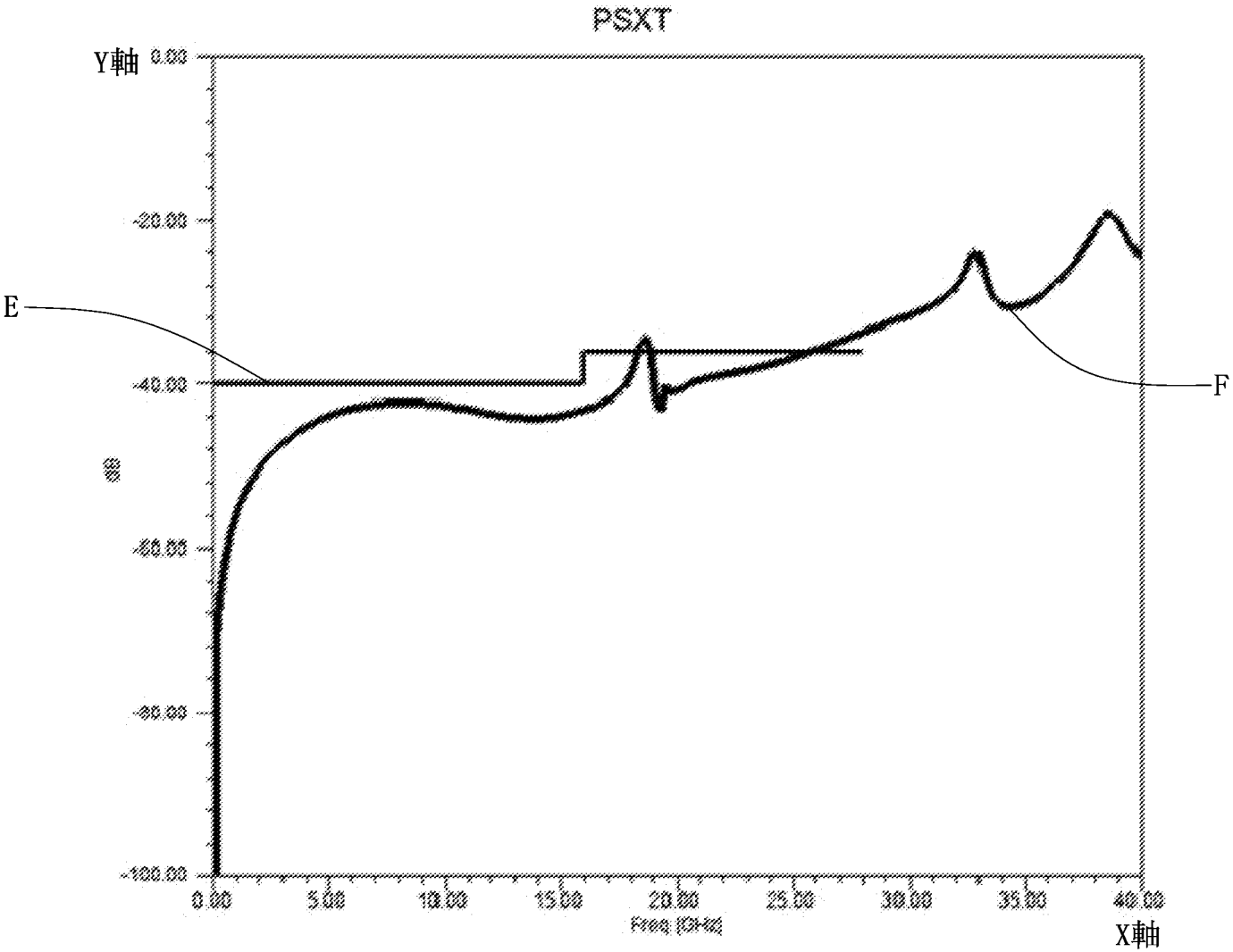
FIG. 11 is a crosstalk summation diagram PSXT when adjusting grooves are provided between two sides of a pair of differential signal terminals and ground terminals on each of the first insulating block and the second insulating block.
Figure 12:
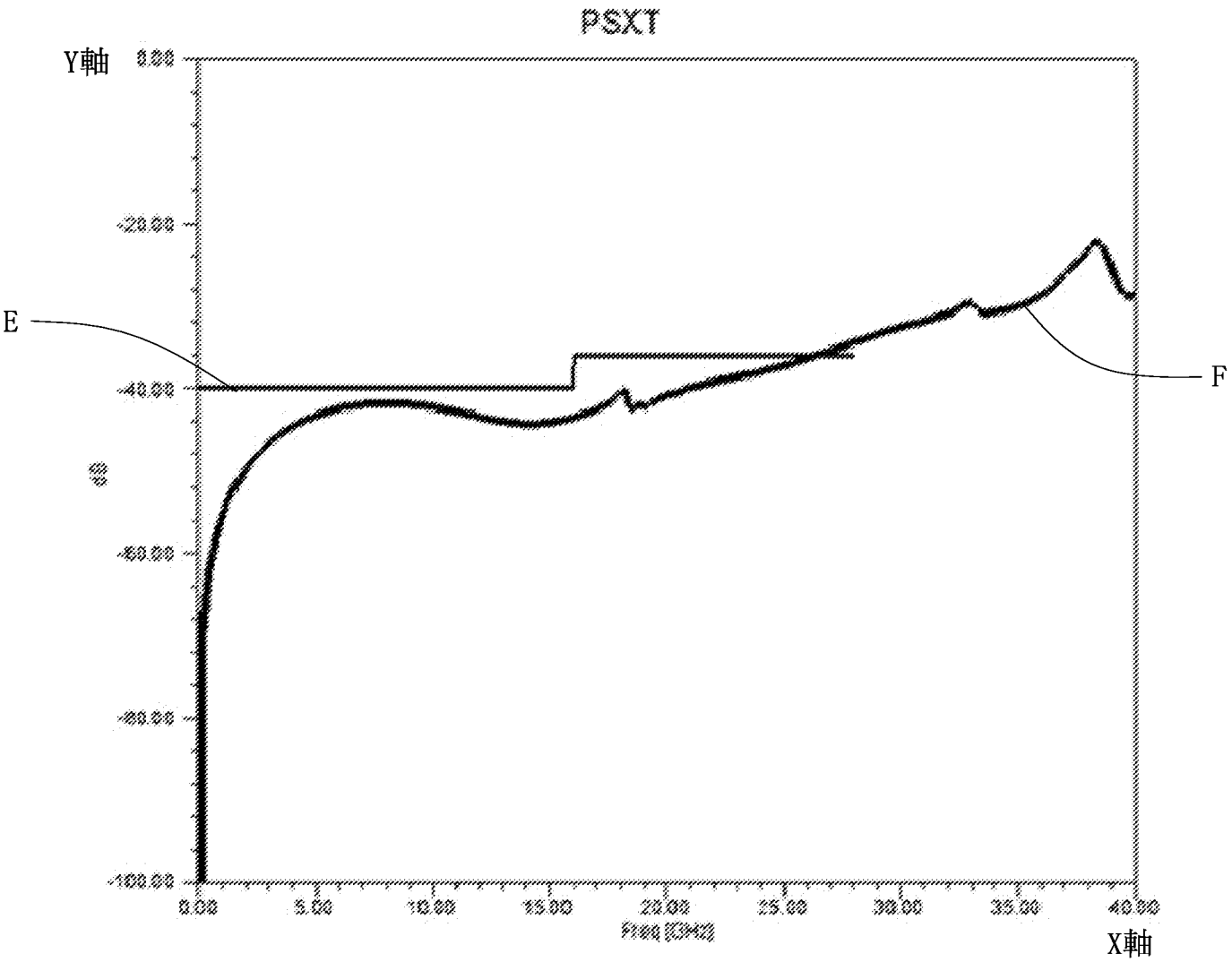
FIG. 12 is a crosstalk summation diagram PSXT when an adjusting groove is provided between only one side of a pair of differential signal terminals and the corresponding ground terminal on each of the first insulating block and the second insulating block.

FIG. 10 is a crosstalk summation diagram PSXT of the first insulating block 2 and the second insulating block 3 not being provided with adjusting grooves 4, where an X axis (i.e., the horizontal axis) indicates the frequency of signals, and a Y axis (i.e., the vertical axis) indicates the decibel value of crosstalk to the total energy of the transmitted signals. A horizontal line E in FIG. 10 indicates a crosstalk value of association standards, crosstalk values satisfying the association standards are below the horizontal line E, and a continuous curve F in the diagram indicates a curve of crosstalk summation. When the frequency of the differential signal terminals 5*a* is about 18 GHz, the ground mode resonance generated by the ground terminals 5*b* to the differential signal terminals 5*a* exceeds the horizontal line E by a greater distance, such that the crosstalk accounts for a large part of the total energy of the transmitted signals, thus not satisfying the crosstalk value of the association standards, and seriously affecting the transmission of high frequency signals. FIG. 11 shows a crosstalk summation diagram PSXT when the adjusting grooves 4 are provided between two sides of a pair of differential signal terminals 5*a* on each of the first insulating block 2 and the second insulating block 3 and the ground terminals 5*b*. As shown in FIG. 11 in comparison to FIG. 10, the ground mode resonance generated by the ground terminals 5*b* to the differential signal terminals 5*a* is significantly lower than that when the adjusting grooves 4 are not provided, but still exceeds the crosstalk value of the association standards. FIG. 12 shows a crosstalk summation diagram PSXT when the adjusting groove 4 is provided between only one side of a pair of differential signal terminals 5*a* on each of the first insulating block 2 and the second insulating block 3 and the ground terminal 5*b*. As shown in FIG. 12 in comparison to FIG. 11, the ground mode resonance generated by the ground terminals 5*b* to the differential signal terminals 5*a* is further lower than that when the adjusting grooves 4 are provided at the two sides, the decibel value of crosstalk to the total energy of the transmitted signals satisfies the crosstalk value of the association standards, and the crosstalk less affects the transmission of high frequency signals, which is beneficial to the transmission of the high frequency signals.

To sum up, the electrical connector 100 according to certain embodiments of the present invention has the following beneficial effects:

(1) Each of two opposite sides of the pair of differential signal terminals 5*a* is provided with a corresponding one of the ground terminals 5*b*. The adjusting groove 4 is provided between only one side of the pair of differential signal terminals 5*a* and the corresponding ground terminal 5*b*, and no adjusting groove 4 is provided between the other side of the pair of differential signal terminals 5*a* and the corresponding ground terminal 5*b*. Thus, a space between one side of the pair of differential signal terminals 5*a* and the corresponding ground terminal 5*b* is filled with air, and a portion of each of the insulating blocks is provided between the other side of the pair of differential signal terminals 5*a* and the corresponding ground terminal 5*b*. The dielectric constant of air is smaller than that of the first and second insulating blocks 2 and 3, such that the dielectric constants of the two sides of the pair of differential signal terminals 5*a* are unbalanced, and electric charges and electric fields between the pair of differential signal terminals 5*a* and the ground terminals 5*b* at the two sides are not distributed uniformly, thus reducing the ground mode resonance of the ground terminals 5*b* to the differential signal terminals 5*a*, and improving the high frequency performance of the electrical connector 100.

(2) The adjusting grooves 4 run through the second insulating block 3 vertically, and a relatively larger space is formed between the differential signal terminals 5*a* and the ground terminals 5*b* to be filled with air, thereby reducing the dielectric constant of the medium between the ground terminals 5*b* and the differential signal terminals 5*a*, and improving the high frequency performance.

(3) Neither the differential signal terminals 5*a* nor the ground terminals 5*b* are exposed to the adjusting grooves 4. The dielectric constants of the first insulating block 2 and the second insulating block 3 are higher than the dielectric constant of air, such that the differential signal terminals 5*a* and the ground terminals 5*b* at the two sides of each of the adjusting grooves 4 in the upper row are completely covered by the first insulating block 2, and the differential signal terminals 5*a* and the ground terminals 5*b* at the two sides of each of the adjusting grooves 4 in the lower row are completely covered by the second insulating block 3. Further, the dielectric constant of the medium between the differential signal terminals 5*a* and the ground terminals 5*b* in the upper row is between the dielectric constants of the first insulating block 2 and the air and the dielectric constant of the medium between the differential signal terminals 5*a* and the ground terminals 5*b* in the lower row is between the dielectric constants of the second insulating block 3 and the air, thus effectively reducing the ground mode resonance of the ground terminals 5*b* to the differential signal terminals 5*a*.

(4) When the contact portions 53*a* and 53*b* urge abut the mating component 200 to be in an operating state, gaps of 0 to 0.1 mm exist between the elastic arms 52*a* and 52*b* and inner wall surfaces of the accommodating grooves in an abutting direction. When the mechanical properties of the electrical connector 100 are satisfied, the gap between the first elastic arm 52*a* and the insulating body 1 as well as the gap between the second elastic arm 52*b* and the insulating body 1 are minimized, and the dielectric constant of the insulating body 1 is relatively larger, such that the increase in the dielectric constant of the medium around the elastic arms 52*a* and 52*b* may effectively reduce the impedance of the terminals 5, thereby improving the high frequency performance.

(5) The adjusting grooves 4 on the two insulating blocks 2 and 3 are staggered in the vertical direction of the insulating blocks. Because the two insulating blocks 2 and 3 are provided with the adjusting grooves 4, the medium coefficient between the upper and lower rows of terminals 5 is reduced, further increasing the signal transmission characteristics of to upper and lower rows of terminals 5. The staggered arrangement of the adjusting grooves 4 on the two insulating blocks 2 and 3 can reduce crosstalk when the two rows of terminals 5 transmit signals.

(6) A first adjusting notch 511*b* is provided at each of two opposite sides of the first fixing portion 51*b*. One side of the first fixing portion 51*b* corresponding to the adjusting groove 4 is concavely provided with one first adjusting notch 511*b*, such that the ground terminal 5*b* is further away from the differential signal terminal 5*a*, thereby reducing the energy of the ground mode resonance generated by the ground terminal 5*b*. In addition, each adjusting groove 4 is provided correspondingly at the first adjusting notch 511*b*, and the dielectric constant of air is relatively small, such that the ground terminal 5*b* can better adjust the ground mode resonance.

(7) A second adjusting notch 511*a* is provided at each of two opposite sides of the second fixing portion 51*a*. Each adjusting groove 4 is provided between the first adjusting notch 511*b* and the second adjusting notch 511*a*, which can adjust the impedance of the differential signal terminals 5*a* and optimize the crosstalk disturbance between the differential signal terminals 5*a*.

(8) Each ground terminal 5*b* has a first virtual center line L1 along an extending direction thereof, and each differential signal terminals 5*a* have a second virtual center line L2 along an extending direction thereof. The distance between the adjusting grooves 4 and the first virtual center line L1 is equal to the distance between the adjusting grooves 4 and the second virtual center line L2, such that the adjusting grooves 4 are located at center locations between the ground terminals 5*b* and the differential signal terminals 5*a*, and the impedance of the differential signal terminals 5*a* can be neutrally adjusted, further optimizing the ground mode resonance of the ground terminals 5*b*, and making the resonance points within a controllable range.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating block, provided with at least one adjusting groove; and a plurality of terminals, fixed to the insulating block and arranged in at least one row, wherein the terminals arranged in each of the at least one row comprise at least one pair of differential signal terminals and at least two ground terminals, and each of two opposite sides of the pair of differential signal terminals is provided with a corresponding one of the ground terminals, wherein each of the ground terminals has a first fixing portion fixed to the insulating block, each of the differential signal terminals has a second fixing portion fixed to the insulating block, a plurality of side edges of the first fixing portion are defined as a plurality of first side edges, and a side edge of the second fixing portion adjacent to the first fixing portion is defined as a second side edge; and wherein for each pair of the differential signal terminals, the adjusting groove is provided between only one second side edge of the two second side edges of the pair of differential signal terminals and one of the first side edges of the corresponding one of the ground terminals located farthest from the one second side edge.

2. The electrical connector according to claim 1, wherein the terminals comprise at least two pairs of differential signal terminals and the at least two ground terminals, arranged sequentially as: a ground terminal, a differential signal terminal, a differential signal terminal, a ground terminal, a differential signal terminal, and a differential signal terminal, and the adjusting groove is provided between only one differential signal terminal of one of the pairs of differential signal terminals and a corresponding one of the ground terminals.

3. The electrical connector according to claim 1, wherein the ground terminals and the differential signal terminals are not exposed to the adjusting groove.

4. The electrical connector according to claim 1, wherein the adjusting groove runs through the insulating block in a thickness direction of the insulating block.

5. The electrical connector according to claim 1, comprising two insulating blocks and further comprising an insulating body, wherein the insulating body has an insertion slot, the terminals are arranged in two rows, each of the two insulating blocks is respectively injection-molded with one of the two rows of the terminals, the two insulating blocks are respectively assembled to the insulating body, each of the terminals has an elastic arm and a contact portion extending from the elastic arm, and the contact portion is exposed to the insertion slot.

6. The electrical connector according to claim 1, comprising two insulating blocks, wherein the terminals are arranged in two rows in a thickness direction of the insulating blocks, and the adjusting grooves on the two insulating blocks are staggered in a thickness direction of the insulating blocks.

7. The electrical connector according to claim 1, further comprising an insulating body, wherein the insulating block is provided on the insulating body, the insulating body is provided with a plurality of accommodating grooves to accommodate the terminals, each of the terminals has an elastic arm and a contact portion extending from the elastic arm, and when the contact portion abuts a mating component, a gap of 0 to 0.1 mm exists between the elastic arm and an inner wall of a corresponding one of the accommodating grooves in an abutting direction.

8. The electrical connector according to claim 1, wherein one side of the first fixing portion corresponding to the adjusting groove is concavely provided with a first adjusting notch.

9. The electrical connector according to claim 8, wherein the first fixing portion is provided with two first adjusting notches, each of two opposite sides of the first fixing portion is respectively provided with one of the two first adjusting notches, the second fixing portion is provided with two second adjusting notches, each of two opposite sides of the second fixing portion is provided with one of the two second adjusting notches, and the adjusting groove is provided between one of the first adjusting notches and one of the second adjusting notches.

10. The electrical connector according to claim 1, wherein one of the ground terminals adjacent to the adjusting groove and one of the differential signal terminals adjacent to the adjusting groove are respectively located at two sides of the adjusting groove, the one of the ground terminals adjacent to the adjusting groove has a first virtual center line along an extending direction thereof, the one of the differential signal terminals adjacent to the adjusting groove has a second virtual center line along an extending direction thereof, and a distance between the adjusting groove and the first virtual center line is equal to a distance between the adjusting groove and the second virtual center line.

* * * * *